US005216859A

United States Patent [19]

Moreno et al.

[11] Patent Number: 5,216,859

[45] Date of Patent: Jun. 8, 1993

[54] DEMOUNTABLE WALL SYSTEM WITH SINGLE PIECE HORIZONTAL SUPPORT MEMBERS AND AN OPEN WALL CAVITY

[75] Inventors: Juan L. Moreno, Kingwood; Ronald J. Allison, Houston, both of Tex.

[73] Assignees: Hugh L. Payne, Houston; Mike Eldridge, Lufkin, both of Tex.

[21] Appl. No.: 693,931

[22] Filed: Apr. 29, 1991

Related U.S. Application Data

[63] Continuation-in-part of Ser. No. 565,184, Aug. 8, 1990, Pat. No. 5,060,434, which is a continuation of Ser. No. 433,971, Nov. 9, 1989.

[51] Int. Cl.[5] ..... E04H 1/00

[52] U.S. Cl. ..... 52/238.1; 52/241; 52/481; 52/489; 52/356; 52/511

[58] Field of Search ..... 52/238.1, 241, 481, 52/489, 356-358, 509, 511

[56] References Cited

U.S. PATENT DOCUMENTS

| | | | |
|---|---|---|---|
| 249,965 | 10/1878 | Cooper . | |
| 1,810,597 | 6/1931 | Corwin . | |
| 1,814,202 | 7/1931 | Winget | 52/356 X |
| 1,876,528 | 9/1932 | Walters . | |
| 1,915,697 | 6/1933 | Robinson | 52/356 X |
| 2,055,442 | 9/1936 | Jones . | |
| 2,097,988 | 11/1937 | Ross et al. . | |
| 2,101,001 | 11/1937 | Balduf . | |
| 2,293,862 | 8/1942 | Sorenson . | |
| 2,325,766 | 8/1943 | Gisondi . | |
| 2,396,030 | 3/1946 | Terry . | |
| 2,642,968 | 6/1953 | Roush et al. | 52/356 X |
| 2,881,924 | 4/1959 | Kruse et al. . | |
| 3,127,145 | 3/1964 | McGinty et al. . | |
| 3,286,412 | 11/1966 | Greig et al. . | |
| 3,295,405 | 1/1967 | Burke . | |
| 3,300,924 | 1/1967 | Ashby et al. . | |
| 3,312,030 | 4/1967 | Gillespie . | |
| 3,416,821 | 12/1968 | Benno . | |
| 3,460,302 | 8/1969 | Cooper . | |

FOREIGN PATENT DOCUMENTS

| | | |
|---|---|---|
| 1002279 | 12/1976 | Canada . |
| 1044870 | 12/1978 | Canada . |
| 8302635 | 8/1983 | PCT Int'l Appl. . |
| 8902502 | 3/1989 | PCT Int'l Appl. . |
| 692084 | 5/1953 | United Kingdom . |
| 1120632 | 7/1968 | United Kingdom . |

OTHER PUBLICATIONS

PS 350 Movable Partition System brochure, Partition Systems (Mfg.) Ltd. (Edmonton and Calgary, Alberta, Canada).

PC 350 Gravity Lock Wall Systems product advertising sheets (3 pages), Partition Components Inc. (Markham, Ontario, Canada) (Sep. 1987).

PC 350 Gravity Lock Wall Systems brochure, Partition Components Inc. (Markham, Ontario, Canada) (Printed in 1988?).

PC 350 Gravity Lock Wall Systems brochure, Partition Components Inc. (Markham, Ontario, Canada) (Printed in 1989?).

*Primary Examiner*—Richard E. Chilcot, Jr.

*Attorney, Agent, or Firm*—Vaden, Eickenroht, Thompson, Boulware & Feather

[57] ABSTRACT

An improved horizontal support member for a demountable wall system which decreases the number of pieces which must be cut and folded, and subsequently assembled, to form a frame to which the gypsum board panels of the wall are assembled while increasing the strength and stability of the wall. The support member is formed from an elongate sheet of metal by making a series of longitudinal cuts in the metal and then folding the cut metal edges along lines which are substantially parallel to the longitudinal cuts to form first and second bars. The space between longitudinal cuts acts as a spacer to maintain the first and second bars in spaced, substantially parallel relationship.

(List continued on next page.)

14 Claims, 2 Drawing Sheets

[U.S. PATENT DOCUMENTS]

| | | | |
|---|---|---|---|
| 3,461,638 | 8/1969 | Balinski | 52/238.1 |
| 3,469,361 | 9/1969 | Winkowski . | |
| 3,482,369 | 12/1969 | Burke . | |
| 3,501,884 | 3/1970 | DiCesare, Jr. et al. . | |
| 3,534,516 | 10/1970 | Cooper . | |
| 3,671,061 | 6/1972 | Dawdy . | |
| 3,842,554 | 10/1974 | Swick . | |
| 3,906,695 | 9/1975 | Pilgrim et al. . | |
| 3,948,011 | 4/1976 | Price et al. | 52/481 X |
| 3,950,904 | 4/1976 | Littman . | |
| 4,118,979 | 11/1978 | Price | 52/241 |
| 4,194,333 | 3/1980 | Paton et al. . | |
| 4,245,448 | 1/1981 | Agar | 52/571 X |
| 4,324,082 | 4/1982 | Rutkowski et al. . | |
| 4,364,212 | 12/1982 | Pearson et al. . | |
| 4,435,936 | 3/1984 | Rutkowski . | |
| 4,448,004 | 5/1984 | Thorsell | 52/241 |
| 4,566,241 | 1/1986 | Schneller . | |
| 4,651,484 | 3/1987 | Rutkowski . | |
| 4,693,047 | 9/1987 | Menchetti . | |
| 4,719,730 | 1/1988 | Winkowski . | |
| 4,765,111 | 8/1988 | Osawa | 52/509 X |
| 4,811,539 | 3/1989 | Menchetti . | |
| 4,837,988 | 6/1989 | Menchetti et al. . | |
| 4,843,784 | 7/1989 | Menchetti et al. . | |
| 5,060,434 | 10/1991 | Allison | 52/238.1 |

DEMOUNTABLE WALL SYSTEM WITH SINGLE PIECE HORIZONTAL SUPPORT MEMBERS AND AN OPEN WALL CAVITY

BACKGROUND OF THE INVENTION

The present application is a continuation-in-part of co-pending application Ser. No. 07/565,184, filed on Aug. 8, 1990, now U.S. Pat. No. 5,060,434 which is in turn a continuation of co-pending application Ser. No. 07/433,971, filed on Nov. 9, 1989, both entitled "Demountable Wall System".

The present invention relates to the combination of multiple suspending gang nail plates on a gypsum board panel, the panel being mounted to a demountable partition wall utilizing a framework of vertical studs and horizontal support members for suspending the panel to form a wall. In recent years, removable partition walls have been widely used for interior finish out of buildings. In general, these walls involve mounting channel-like tracks on the floor and ceiling, installing vertical, channel-like metal studs in laterally spaced relationship between the runners, and securing gypsum board (sheetrock) panels to the studs. However, this technique is labor intensive because it requires that several operations be conducted on the joints between panels, e.g., they must be filled, taped and concealed with battens, to produce a neat, finished appearance.

A battenless system is described in U.S. Pat. No. 3,550,338, but the system described in that patent is characterized by a number of disadvantages and limitations, most importantly, that the metal strips used in the system must be of substantial length and width. This requirement arises from a shortcoming which is characteristic of gypsum board, namely that the bond between the board filling and the paper layer is frequently weaker in certain portion of the panels than others. By providing long, wide strips, the system described in that patent ensures that at least portions of each strip will be attached to properly bonded material. Such strips are, however, relatively expensive, and thus contribute significantly to the cost of the system. Further, the strips, and the hooks and cut-outs of the system, must be precisely manufactured and positioned so that adjacent panels will be drawn into closely abutting relation. This precise manufacturing and assembly likewise adds to the cost of the system. Another limitation of this type of system is that considerable stress is placed on a relatively narrow portion of the stud due to the weight of the panels. This concentration of the weight leads to the sagging and weakening of the lateral stability of the wall. However, the wall usually is not reinforced to overcome this tendency because of the additional cost.

Another system is described in U.S. Pat. No. 3,948,011. That patent describes a system which includes gang nail plates which are said to be relatively inexpensive and easily attached to the back of a gypsum board panel for assembly into a wall system including horizontal channel members. Such a system is said in that patent to be competitive, price wise, with those systems on the market which use only vertical studs. This system is, however, likewise characterized by a number of disadvantages and limitations, as evidenced by the improvement patents, U.S. Pat. Nos. 4,128,979, 4,245,448, 4,394,808, 4,448,004, and 4,693,047 directed to various components of that same system that were ostensibly designed to solve the various problems encountered in erecting the system described in U.S. Pat. No. 3,948,011 (the "'011 patent").

Another limitation of the system described in that patent is not apparent from a description of the content of the specification of that patent. Specifically, that patent is, on information and belief, presently licensed exclusively to the National Gypsum Company's Gold Bond Building Products distribution system, and (in spite of the indication in the specification of the patent that the system is competitive, price-wise, with other systems on the market) when purchased from that licensee, the system has an installed price which is actually higher than the price at which permanently mounted dry wall can be installed. That cost has provided the motivation for the present invention, e.g., to provide a system which actually does have the cost and other advantages touted in the specification of the '011 patent for that system.

Another object of the present invention is to provide a demountable wall system in which the space between gypsum board panels is substantially open to allow the flexibility of routing wires, cables, conduit or other utilities vertically within the wall cavity without obstructions, a significant advantage in a business or other environment in which computers, telephones, and other electronic equipment must be networked or linked together, an object which is not achievable with the system described in the '011 patent.

Another object of the present invention is to provide a demountable wall system which is assembled quickly and which requires minimal use of hand tools, using gravity and the weight of the components thereof to pull adjacent gypsum board panels into alignment with each other.

Another object of the present invention is to provide a demountable wall system which can be manufactured at low cost due to the minimal number of cuts and bends required to work the metal comprising each component of the system.

Another object of the present invention is to provide a demountable wall system having increased lateral stability over those wall systems which are currently available.

Other objects, and the advantages of the present invention, will be made clear by the following detailed description of one demountable wall system which is constructed in accordance with the present invention.

SUMMARY OF THE INVENTION

These objects, and the advantages of the present invention, are achieved by providing a demountable wall system comprising first and second channel-like track members mounted horizontally onto a ceiling and floor, respectively, in confronting relationship and a plurality of spaced, vertical studs which extend from floor to ceiling track members. Each stud is provided with laterally extending flanges, and the flanges are provided with a plurality of cut-outs at spaced intervals along the length of the stud, each of the cut-outs having a retaining member representing the cut-out portion of the flange, extending at an angle from the base of the cut-out. The bars of a horizontal support member rest in the angle formed by the retaining member and the inside surface of the flange of adjacent studs. The support member is comprised of first and second bars formed by folding the edges of an elongated metal sheet along two substantially parallel lines on each side of a series of spaced, longitudinal cuts between the lines and a plurality of spacers, representing the metal portions between the longitudinal cuts, for holding the bars in substantially parallel, spaced relationship.

Also provided is a plurality of suspension clips, each of the clips having a cut-out therein, the cut-outs having an angled member representing the cut-out portion of the clip extending outwardly therefrom. The suspension clips are affixed to gypsum board panels, the angled member of the clips resting on one of the support member bars so that the weight of the gypsum board panel both causes the panel to engage the support member tightly and causes the support member to engage the studs tightly, thereby ensuring close abutment and alignment of adjacent gypsum board panels to form smooth joints therebetween.

The suspension clip used to support the gypsum board panel also constitutes part of the present invention. That clip comprises a gang nail plate, preferably made of metal, for applying to the surface of a gypsum board panel, having a cut-out portion therein and a plurality of gang nails located above and below the cut-out. An angled member, representing the cut-out portion of the cut-out in the gang nail plate, is bent outwardly from the gang nail plate for engaging the support member bar of a demountable wall system over which it extends when the gang nails of the gang nail plate are driven into the gypsum board panel to support the gypsum board panel on the horizontal support member of a wall frame comprised of vertical studs having horizontal members supported thereon. A plurality of punch-outs, randomly distributed over the gang nail plate on both sides of the cut-out portion and between the upper and lower pluralities of gang nails, are provided to cause the bowing of the gang-nail plate so that the gang nails pinch inwardly to resist removal of the gang nail plate from the gypsum board to which the clip is applied.

DETAILED DESCRIPTION OF THE PREFERRED EMBODIMENT

Figure 1:
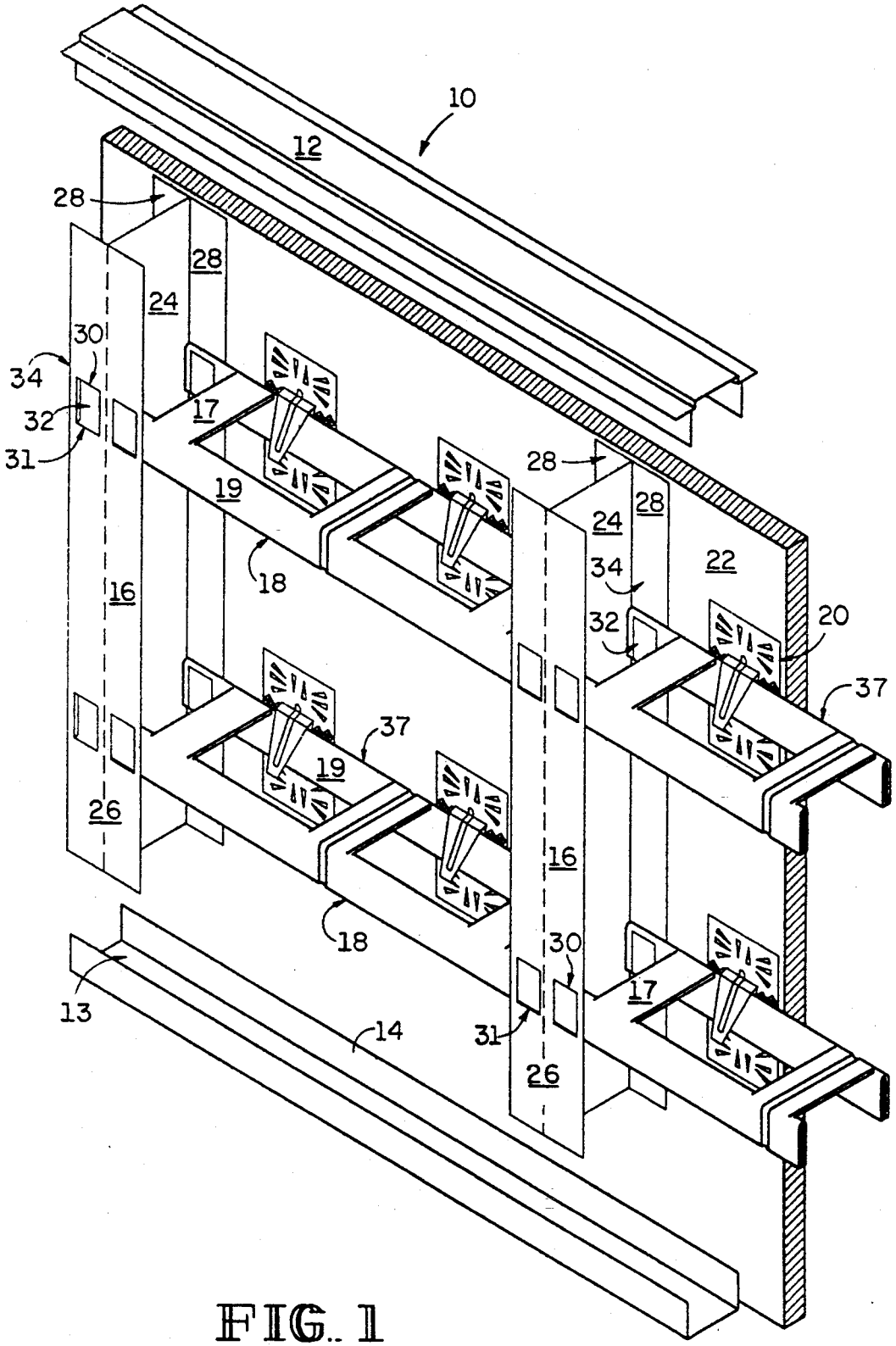
FIG. 1 is an exploded, perspective view of two adjacent studs and their companion horizontal support members in a demountable wall system constructed in accordance with the teachings of the present invention.

Referring to FIG. 1, there is shown a perspective view of the various components comprising the demountable wall system 10 of the present invention. The system 10 is comprised generally of ceiling and floor track members 12 and 14, respectively, vertical studs 16, horizontal support members 18, suspension clips 20, and gypsum board panels 22. As shown in FIG. 1, the ceiling 12 and floor 14 track members are comprised of U-shaped track, or channel members, having the base 13 thereof adjacent the ceiling (not shown) and floor (also not shown) such that the open end of the "U" receives the respective ends of studs 16, e.g., ceiling 12 and floor 14 track members are assembled into system 10 in confronting relationship.

Studs 16 are oriented vertically with respect to ceiling 12 and floor 14 track members and are spaced apart from each other on, for instance, sixteen, twenty-four or forty-eight inch centers as is known in the industry, or any other spacing as may be required or convenient. As will be explained below, the system of the present invention makes possible the use of forty-eight inch spacing in almost all applications, thereby resulting in significant cost savings in the time of installation as well as material costs.

The studs 16 are preferably comprised of I-beams having a web 24 and chord 26, each chord 26 being comprised of laterally-extending flanges 28. The flanges 28 are provided with a plurality of cut-outs 30 longitudinally spaced at regular intervals along the length of each stud 16 for a purpose to be made clear below. The cut-outs 30 are formed by stamping with a die (not shown) which shears on two or three sides, but bends rather than shears, along the one edge 31 such that each of the cut-outs 30 is provided with a retaining member 32 representing the cut-out portion of the stud 16 extending at an angle from the surface 34 of the flanges 28 and attached at the base 31 of the cut-out 30.

Each of the first and second bars 19' and 19'' comprising support member 18 (see FIG. 3) rests in an angle formed by the retaining member 32 and the surface 34 of the flanges 28 of adjacent studs 16. As will be explained, the support members 18 support the gypsum board panels 22, and the weight of gypsum board panel 22, combined with the angle formed by the retaining member 32 and the surface 34 of the flanges 28, secures the joint between support member 18 and stud 16. Further, the secure nature of that joint is accomplished without the use of tools to make the connection: all that is required is that the first and second bars 19 of horizontal support member 18 rest in the angle between retaining member 32 and surface 34 and that downward force (e.g., gravity acting on the gypsum board panel 22) be exerted on support member 18. Securing this joint greatly facilitates the alignment of two adjacent gypsum board panels 22 at a stud 16 in close abutment to form a smooth joint therebetween because the angle of retaining member 32 effectively acts as a camming surface, the action of which results in outward pressure on gypsum board panel 22.

Figure 2:
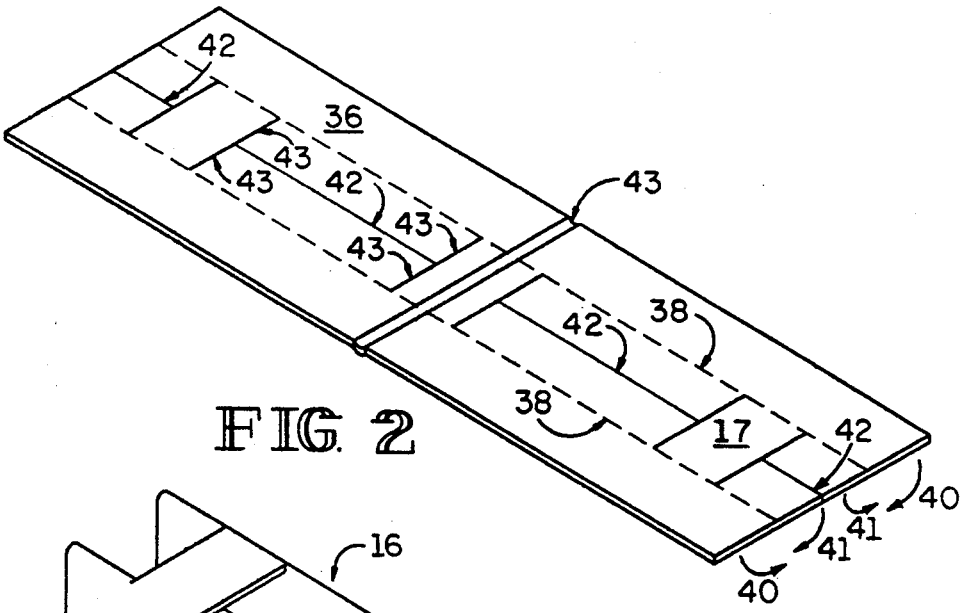
FIG. 2 is an enlarged, perspective view of one of the horizontal support members of FIG. 1 before that member is cut and folded into the configuration of the support member of FIG. 1.
Figure 3:
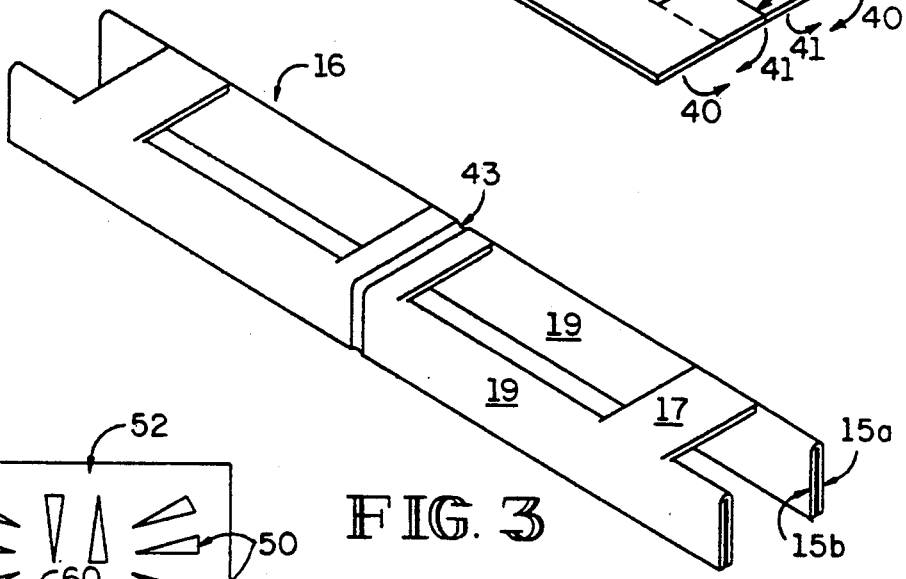
FIG. 3 is a perspective view of the support member of FIG. 2 after that member has been cut and folded into the configuration of the horizontal support member shown in FIG. 1.

Referring now to FIGS. 2 and 3, the support member 18 of system 10 will be discussed in detail. As will be apparent to those skilled in the art who have the benefit of this disclosure, it is contemplated that support member 18 be made of metal. FIG. 2 shows a flat, elongate metal sheet 36 from which support member 18 is formed as follows. The metal sheet 36 is cut in a series of spaced, longitudinal cuts, with crosscuts at the ends of each longitudinal cut, represented by the lines 42 and 43, respectively, shown in FIG. 2. The cut edges of metal sheet 36 are then bent or folded along two substantially parallel lines, represented by the dotted lines 38 on both sides of the spaced, longitudinal cuts 42, in the direction of arrows 40 and 41 to form first and second bars 19 of the horizontal support members 18. The uncut portions of the metal sheet 36, e.g., the portions of the metal sheet 36 between the spaced, longitudinal cuts 42, act as spacers 17 for holding the first and second bars 19' and 19'' in spaced, substantially parallel relationship as shown in FIGS. 1 and 3. One of the spacers 17 of support member 18 is provided with means, in the form of a groove 43 running substantially perpendicularly to the fold lines 38, for increasing the resistance of the support member 18 to torsional force. Each bar 19 of support member 18 is thus comprised of legs 15*a* and 15*b* representing the edges of the metal sheet 36 when folded along lines 38. Not only do the bars 19 therefore resist the sagging of support member 18 when a gypsum board is supported thereon, but they also represent a means for increasing the resistance of the support member 18 to pivotal movement, as would result from the exertion of force against a wall at one stud but not another, relative to the stud 16.

Metal is the material of choice for forming support member 18 because of applicable fire code regulations. Other materials can also be used if they are able to meet those standards. For instance, a rigid, non-flammable plastic could be molded in the configuration shown in FIGS. 1 and 3 which would not require the subsequent cutting along lines 42 and 43 and folding in the directions of the arrows 40 and 41 shown in FIG. 2 but which would function in a similar manner to accomplish a similar result.

Figure 5:
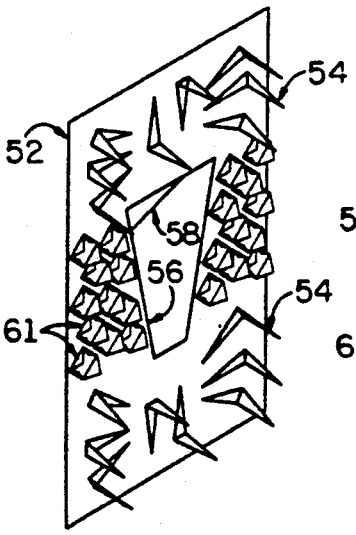
FIG. 5 is a perspective view of the suspension clip of FIG. 4.
Figure 6:
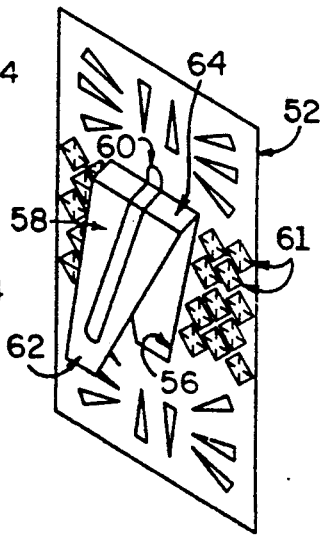
FIG. 6 is a perspective view of the suspension clip of FIG. 4 from the opposite side of the view of FIG. 5.

Suspension clip 20 (FIGS. 4–6) is comprised of a gang nail plate 52 for applying to a gypsum board panel such as that shown at reference numeral 22 in FIG. 1. When driven into gypsum board panel 22, the nails 54 of gang nail plate 52 affix suspension clip 20 thereto. It will be understood by those skilled in the art who have the benefit of this disclosure that other materials could be supported with suspension clip 20 besides sheetrock. The suspension clip 20 could be used, for instance, for supporting wooden paneling, plywood or other engineered lumber product, sound insulating material, baffles, and so on.

Gang nail plate 52 is provided with a cut-out 56 and an angled member 58 bent outwardly from the gang nail plate 52. Angled member 58 represents the cut-out portion of the gang nail plate 52, and for ease in shipping, manufacturing and handling, as well as affixing to a gypsum board panel 22, angled member 58 is only sheared from the legs, or sides, of the cut-out 56 and pressed roughly parallel to gang nail plate 52. The groove 60 running along the longitudinal aspect of angled member 58 provides rigidity to that member 58 and serves an additional function as well. Specifically, because of the close spacing of angled member 58 from gang nail plate 52 (which is shown enlarged in the figures for purposes of clarity), it may be difficult to catch the edge of one of the support members 19 when it is desired to rest a gypsum board panel 22 to which the suspension clip 20 is affixed with the tip 62 of the angled member 58. Consequently, the bottom of the groove 60 is oriented toward the side of gang nail plate 52 which contacts gypsum board panel 22. In that manner, the tip 62 of angled member 58 is forced outwardly from the surface of gypsum board panel 22 when suspension clip 20 is affixed thereto by driving the gang nails 54 into the gypsum board panel 22.

Figure 4:
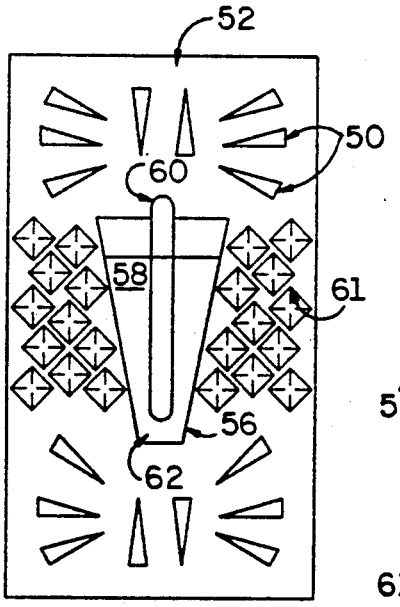
FIG. 4 is a plan view of a presently preferred embodiment of a suspension clip constructed in accordance with the teachings of the present invention and which is to be affixed to a gypsum board panel for resting on the horizontal support member of FIG. 1.

Referring now to FIG. 4, it can be seen that the portions of the gang nail plate 52 of suspension clip 20 on both sides of the cut-out 56 therein are provided with a plurality of randomly distributed punch-outs 61, while the gang nails 54 are located above and below the cut-out 56. This configuration of gang nail plate 52 results in a large area of relative lack of rigidity in the plate 52 between the upper and lower portions of plate 52. When the plate 52 is subjected to a stress having a force vector component which is substantially perpendicular to the surface of a gypsum board panel (not shown in FIG. 4) into which the gang nail plate 52 is driven such as the downward force of gravity, this configuration comprises means for causing the plate 52 to bow between upper and lower portions of gang nail plate 52. Such force vectors can also result, for instance, from an attempt to remove the gang nail plate 52 from a gypsum board panel. That bowing causes the nails 54 in the portions of gang nail plate 52 that are located above and below the cut-out 56 to pinch inwardly to provide additional resistance to an effort to wrench the plate 52 from the panel. That same bowing operates to reduce the likelihood that the suspension clip 20 will pull away from a gypsum board panel when the panel 22 supported on support member 18 by the resting of the angled member 58 thereon as shown in FIG. 1 is loaded by, for instance, wall mounted book shelves or furniture (not shown).

Angled member 58 is bent outwardly from gang nail plate in a bend 64 (FIG. 6) for engaging the edge of one of the bars 19 of the support member 18 over which the angled member 58 rests when the gypsum board panel 22 to which suspension clip 20 is affixed is supported by the gang nail plate 52 on support member 18. The bend 64 is shown in exaggerated proportion in FIGS. 5 and 6 because, as described above, the spacing between gang nail plate 52 and angled member 58 has been enlarged for purposes of clarity. The groove 60 continues down off of angled member 58 through the bend 64 to provide rigidity to resist any additional bending of the angled member 58 at bend 64, thereby effectively acting as a stop. In this manner, downward movement of the gypsum board panel 22 to which suspension clip 20 is affixed is limited by engagement of the edge of the bar 19 and angled member 58, allowing lateral movement of the gypsum board panel 22, even once it has been installed on the structural framework of studs 16 and support members 18, to facilitate close abutment of adjacent gypsum board panels 22 to form smooth joints therebetween while limiting downward movement of panel 22 with respect to support member 18 as a result of the weight of panel 22.

Lateral stability of the entire system is enhanced by selecting the length of metal sheet 36 so that the ends of the bars 19 of support members 18 abut adjacent studs of the demountable wall system. Note also that, when folded along the lines 38 to form two legs 15*a* and 15*b* representing one of the bars 19 of support member 18, the number of surfaces bearing against the stud 16 which the support member 18 abuts is increased. As described above, that increase helps resists pivotal movement of the support member 18 relative to stud 16, thereby increasing the stability of the wall system 10.

As noted above, one of the objects of the present invention is to provide a demountable wall system which is economical in materials, cost, and installation time. As should be apparent to those skilled the art who have the benefit of the preceding disclosure, one manner in which installation time is decreased in the case of the present invention is the elimination of the necessity of using several hand tools during erection of the system 10 (it is, expected, however, that installers will carry tools such as a rubber-headed mallet for tapping adjacent gypsum board panels 22 into alignment and other tools as are known in the art). Additional cost savings can be achieved by spacing the studs on forty-eight inch centers instead of twenty-four inch centers. The demountable wall system 10 of the present invention provides, for one of the first times insofar as is known, a system in which such spacing can be accomplished without compromising the strength and/or load-bearing properties of the wall.

The present invention also solves a problem which has been a significant obstacle to the marketing of known demountable wall systems, even those in which the studs are installed on twenty-four inch centers; namely, that of the "flexing" of the gypsum board panel. In other words, even though the load-bearing capabilities of the wall are well above the stated specifications, it has proven difficult, in spite of the many advantages, to convince the prospective purchaser to install such a wall system when the purchaser need only to push against the wall between two studs to feel the wall flex by perhaps as much as three quarters of an inch. The dual leg configuration of the support member bars 19 and self-contained spacer design 17 of the support member 18 help to solve this flexing problem because of the rigidity imparted to the support member 18 by the cutting and folding of plate 36 as described above in connection with the description of FIG. 2. Any force exerted against one gypsum board panel 22 is transmitted through spacers 17, and across support member 18 to the gypsum board panel 22 resting on the opposite chord 26 of stud 16, thereby providing additional resistance to flexing.

Having described these preferred embodiments of a demountable wall system constructed in accordance with the present invention, it is important to note that this description is provided for the purpose of providing exemplification of the invention. As will be recognized by those skilled in the art from this description, there are many changes that can be made to that preferred embodiment without departing from the spirit of the present invention. Such changes are intended to fall within the scope of the following claims.

What is claimed is:

1. A support member for mounting a gypsum board panel to the vertical studs of a demountable wall system with a plurality of suspension clips that rest on said support member comprising first and second bars formed by folding the edges of an elongate metal sheet along two substantially parallel lines on both sides of a series of spaced, longitudinal cuts between said lines and a plurality of spacers, representing the uncut portions of said metal sheet between said longitudinal cuts, for holding said bars in spaced, substantially parallel relationship, the length of said elongate metal sheet being selected so that when bent along said lines, the ends of said bars abut adjacent studs of the demountable wall system to increase the lateral stability of the system.

2. The support member of claim 1 wherein one of said spacers is provided with means for increasing the resistance of said support member to torsional force.

3. The support member of claim 2 wherein said torsional force resistance means comprises a groove in the metal of said spacer, said groove being substantially perpendicular to said lines along which said metal sheet is folded.

4. A support member for mounting to the vertical studs of a demountable wall system including a gypsum board panel supported by a plurality of suspension clips resting on said support member, comprising:

first and second bars formed by cutting an elongate metal sheet in spaced, longitudinally extending cuts and folding the cut metal along two lines on each side of and parallel to the longitudinal cut and a plurality of spacers connecting said bars and holding said bars in substantially parallel, spaced relationship, said spacers representing the portions of said elongate metal sheet which were not cut by said longitudinal cut and folded to form said bars, the length of said elongate metal sheet being sized so that the ends of said bars abut the adjacent studs of the demountable wall system to increase the lateral stability of the system.

5. The support member of claim 4 wherein each of said first and second bars is comprised of two legs representing the edges of the metal sheet when folded along the lines on each side of said longitudinal cut for resisting the sagging of said bars when a gypsum board panel is supported thereon.

6. The support member of claim 4 wherein each of said first and second bars is comprised of two legs representing the edges of the metal sheet when folded along the lines on both sides of said longitudinal cut for increasing the number of surfaces bearing against the studs which said bars abut to increase the resistance of the support member to pivotal movement relative to the stud.

7. The support member of claim 4 additionally comprising a groove in one of said spacers, said groove being substantially perpendicular to the lines on both sides of said longitudinal cut, for increasing the resistance of the support member to torsional forces.

8. A demountable wall system comprising:

first and second track members mounted on a ceiling and floor, respectively, in confronting relationship;

a plurality of spaced, vertical studs extending between said first and second track members, each stud having laterally extending flanges thereon with a plurality of cut-outs spaced therealong, each of the cut-outs having a retaining member representing the cut-out portion thereof extending at an angle from the base thereof;

a horizontal support member comprised of first and second bars formed by folding the edges of an elongate metal sheet along two substantially parallel lines on both sides of a series of longitudinal cuts in said metal sheet, said longitudinal cuts being positioned between said lines, and a plurality of spacers representing the metal portions between said longitudinal cuts for holding said bars in spaced, substantially parallel relationship;

a plurality of suspension clips, each of said clips having a cut-out therein and an angled member, representing the cut-out portion thereof, extending outwardly therefrom; and a plurality of gypsum board panels having said suspension clips affixed thereto, the angled member of said suspension clips resting on said horizontal support members whereby the weight of said gypsum board panel both causes said panel to tightly engage said horizontal support member and the bars of said horizontal support member to tightly engage said studs to align adjacent gypsum board panels in close abutment to form smooth joints therebetween.

9. The demountable wall system of claim 8 wherein said spacers hold said first and second bars of said horizontal support member in substantially parallel spaced relationship.

10. The demountable wall system of claim 8 wherein each of said suspension clips comprises a gang nail plate, the nails of which are driven into said gypsum board panels to affix said suspension clips thereto.

11. The demountable wall system of claim 8 wherein each of said first and second bars of said horizontal support member is comprises of two legs representing the edges of the metal sheet when folded along the lines on both sides of the longitudinal cut for resisting the sagging of said bars when a gypsum board is supported thereon,

12. A suspension clip for affixing to a gypsum board panel for demountably supporting the gypsum board panel on the horizontal support member comprising part of a demountable wall system comprising:

a gang nail plate having a cut-out portion therein and portions having a plurality of gang nails located therein above and below said cut-out;

an angled member representing the cut-out portion of said gang nail plate bent outwardly from said gang nail plate for engaging the horizontal support member of a demountable wall system over which said angled member extends when the gang nails of said gang nail plate are driven into the gypsum board panel support the gypsum board panel on the horizontal support member; and a plurality of punch-outs on both sides of said cut-out and between the upper and lower portions of said gang nail plate to allow bowing of said gang nail plate on either side of said cut-out whereby the gang nails pinch inwardly to provide additional resistance to removal of said gang nail plate from the gypsum board panel to which said gang nail plate is applied.

13. The suspension clip of claim 12 wherein said punch-outs are distributed randomly over the surface of said gang nail plate on both sides of said cut-out.

14. The suspension clip of claim 12 wherein said punch-outs do not align with each other, thereby forming an area between the upper and lower portions of said gang nail plate which is uniformly susceptible to the bowing of said gang nail plate between the upper and lower portions of said gang nail plate.

* * * * *